United States Patent [19]

Stowers et al.

[11] 4,296,990

[45] Oct. 27, 1981

[54] ELECTRICAL CONNECTOR HAVING INSULATED LOCKING SHELL FOR USE ON PANEL HAVING METAL GROUND PLANE

[75] Inventors: Jeffery P. Stowers, Mt. Sidney; Kimball E. Stowers, Ft. Defiance, both of Va.

[73] Assignee: Virginia Panel Corporation, Waynesboro, Va.

[21] Appl. No.: 123,894

[22] Filed: Feb. 22, 1980

[51] Int. Cl.[3] ..... H01R 13/627

[52] U.S. Cl. ..... 339/128; 339/217 S

[58] Field of Search ..... 174/153 R, 6; 339/217 R, 217 J, 217 S, 126 R, 126 J, 128, 143 R, 17 C

[56] References Cited

U.S. PATENT DOCUMENTS

| | | | |
|---|---|---|---|
| 2,903,670 | 9/1959 | Sitz | 339/217 J X |
| 3,004,238 | 10/1961 | Damon | 339/126 J X |
| 3,156,516 | 11/1964 | Minor | 339/217 S |
| 3,244,801 | 4/1966 | Dozier | 339/126 J X |
| 3,702,455 | 11/1972 | Raynor et al. | 339/128 |

*Primary Examiner*—Eugene F. Desmond

*Attorney, Agent, or Firm*—B. P. Fishburne, Jr.

[57] ABSTRACT

A connector having a self-locking insulating holding shell for a replaceable spring contact probe is particularly useful in making connections through panels or modules which include a metallic ground plane for electrical noise suppression. Such panels or modules are commonly used in computer interface equipment and elsewhere where a multitude of electrical connections must be established. Following removal of the spring contact probe from the shell, the shell can be separated from the panel or module without need for a tool.

4 Claims, 6 Drawing Figures

FIG. 1
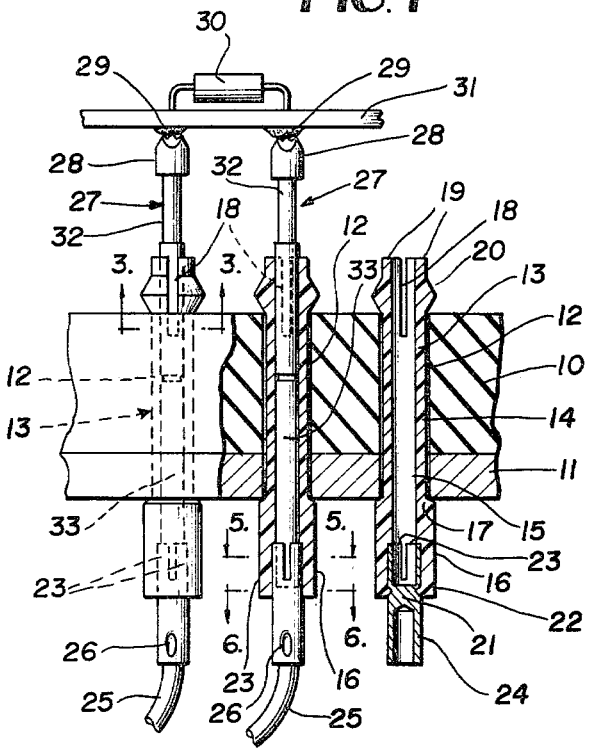
FIG. 2
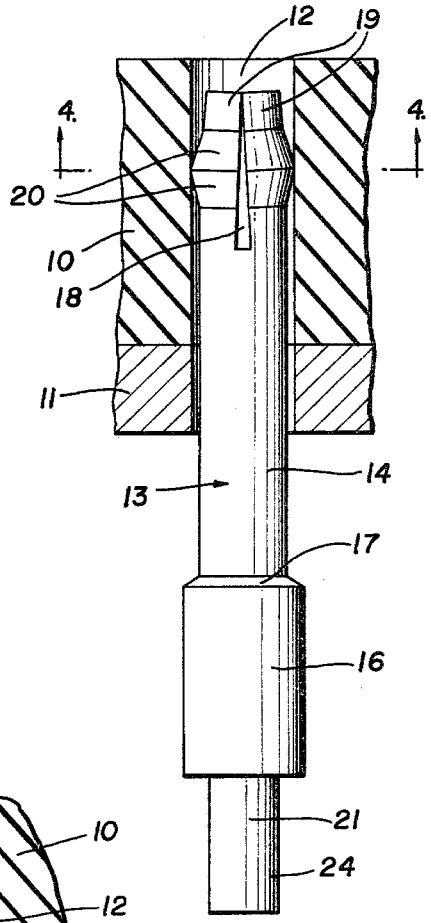
FIG. 3
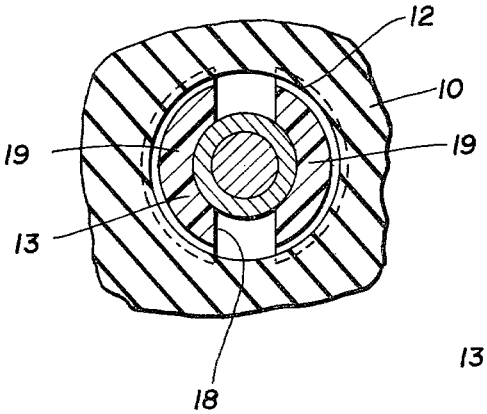
FIG. 4
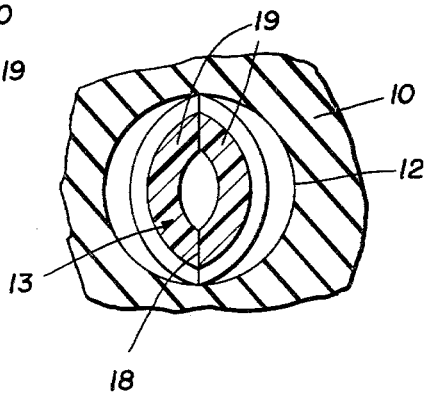
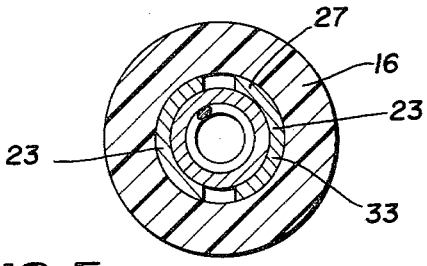
FIG. 5
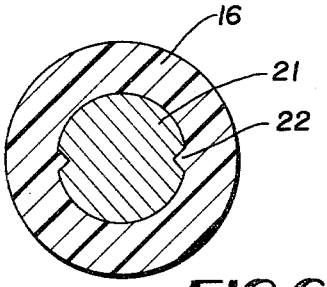
FIG. 6

ELECTRICAL CONNECTOR HAVING INSULATED LOCKING SHELL FOR USE ON PANEL HAVING METAL GROUND PLANE

BACKGROUND OF THE INVENTION

Prior U.S. Pat. No. 3,212,052 discloses an electrical connector wherein a female completely metallic slotted spring contact element is insertable into a bore of an insulating body or holder and expanded into firm locking engagement with the holder when a male contact element is inserted into the slotted end of the female element. Only when the male element is removed can the slotted female metallic contact element be separated from the insulating holder and only then with the assistance of a tool. The patented device has other limitations including a lack of suitability for applications where the holder or body is metallic or includes a metallic layer.

The objective of the present invention is to improve on the construction and operation of the prior patented device and to expand the range of utility of that type of device so that it may be employed on holders, bodies, panels or other modules formed of metal, dielectric material, or part metal and part dielectric material.

Another object of the invention is to dispense with the necessity of a tool when separating the insulating shell from the panel or module after removal of the male spring contact from the shell.

A further object is to reduce the cost of manufacturing of the electrical connector by reducing the amount of metal employed and by constructing the insulating shell to accept a standard commercial-type of replaceable spring contact probe.

Yet another object of the invention is to provide a connector to meet the specific needs of widely used computer interface equipment.

Other objects and advantages of the invention will become apparent during the course of the following detailed description.

BRIEF DESCRIPTION OF THE DRAWINGS

FIG. 1 is a fragmentary central vertical section, partly in elevation, taken through electrical connectors and associated elements in accordance with the invention.

FIG. 2 is an enlarged fragmentary vertical section depicting the removability of the insulating holding shell without a tool.

FIG. 3 is an elarged horizontal transverse section taken on line 3—3 of FIG. 1.

FIG. 4 is a similar section taken on line 4—4 of FIG. 2.

FIG. 5 is a similar section taken on line 5—5 of FIG. 1.

FIG. 6 is a similar section taken on line 6—6 of FIG. 1.

DETAILED DESCRIPTION

Referring to the drawings in detail wherein like numerals designate like parts, the numeral 10 designates a mounting panel, block or other module formed of dielectric material and having attached thereto on one surface thereof a metal layer or ground plane 11 for the purpose of suppressing and controlling electrically-induced noise. The composite member 10-11 may be part of a test adapter or a receiver used in computer interface equipment or may be some other electrical component.

The mounting panel and attached metal ground plane have a required number of spaced, parallel through bores 12 formed therein to receive lockingly and removably holding shells 13 in accordance with the present invention. Each holding shell 13 is preferably formed from a tough electrically insulating material, such as "DELRIN" plastics and has a cylindrical sleeve body 14 including a straight bore 15. At one end, the shell has an enlarged cylindrical extension 16 and a tapered annular shoulder 17 at the junction of the extension 16 with the sleeve body 14.

At its opposite end, the insulating shell 13 is cross-slotted through its side wall as shown at 18 to define two opposing resiliently yielding arcuate jaws 19 on the holding shell 13. Approximately midway between the ends of these jaws, as defined by the depth of the slot 18, external oppositely axially conically tapered camming surfaces 20 protrude from the sleeve body 14, as shown. This arrangement enables the insulating holding shell 13 at proper times to be plugged into the mounting panel 10 and separated therefrom solely by push-pull camming actuation and without the aid of an extracting tool. As shown in the drawings, when the shell 13 is pushed into one end of the bore 12, the leading camming surfaces 20 will engage the mouth of the bore and force the jaws 19 together, as shown in FIG. 2 and in FIG. 4, so that the shell may pass through the bore 12 to the use position shown in FIG. 1. When the surfaces 20 emerge from the bore 12, the resilient jaws 12 expand to their normal relaxed parallel positions and the rearmost surfaces 20, together with the shoulder 17, lock the shell to the panel 10 by engagement with the opposite ends of the bore 12.

Within the opposite or rear end of each shell 13 defined by the enlarged extension 16 is a metal contact element 21 which is molded in or otherwise permanently fixed to the insulating sleeve 13 by known techniques as indicated at 22. The metal contact element 21 includes two opposing arcuate contact paddles 23 within the bore of extension 16 and being coaxial with the bore 15. Outside of the shell 13, contact element 21 includes a short sleeve extension 24 into which a conductor 25 is engaged and secured by crimping at 26 or by other conventional means.

The electrical connector additionally comprises in conjunction with each holding shell 13 a male spring contact probe 27 of the type manufactured and sold by Virginia Panel Corp., 1400 New Hope Rd., P.O. Box 1106, Waynesboro, Va. 22980, under Catalog No. 104, or other equivalent male contact. The spring contact probe 27 includes a serrated head 28 which may be solder connected as at 29 with any electrical component 30 on an external panel 31, for example. The stem 32 carrying the head 28 is spring-urged axially outwardly from the holding shell 13 by a small internal coil spring within the sleeve body 33 of the contact probe 27. The end portion of the contact probe 27 away from its head 28 defined by the sleeve body 33 is removably socketed inside of arcuate paddles 23 whenever the contact probe 27 is plugged into the holding shell 13 in the manner shown in FIG. 1 to complete a connection. The entire contact probe 27 is metallic.

A feature of the invention is that while the contact probe 27 is snugly engaged in the bore 15 of holding shell 13 the yielding jaws 19 of the shell cannot close and the connector is positively and safely locked on mounting panel 10.

Another feature of the invention is that the shell 13 completely insulates the contact probe 27 and electrically connected components and the conductor 25 and contact element 21 from the metal ground plane 11, thereby preventing a short circuit. The insulating shell 13 allows the connector to be used if necessary on an all-metal mounting panel or module or on an all-dielectric mounting panel. This versatility of usage of the connector is not possible where the holding shell itself is metallic.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. An electrical connector for making a connection through a support panel having a metallic layer thereon and having an aperture formed entirely therethrough, said connection being between a conductor spaced from one side of the panel and a circuit element spaced from the other side thereof, said connector comprising a holding shell formed of insulating material and adapted for placement through said aperture of the panel and metallic layer with opposite end portions of the shell projecting beyond the opposite faces of the panel and metallic layer, said shell having a cross slot in one end thereof forming two yielding jaws, camming enlargements on said jaws including oppositely tapering faces engageable with the entrances of the aperture to collapse the jaws toward each other to enable inserting the shell through said aperture and withdrawing the shell therefrom, said shell being hollow, a spring contact probe snugly engaged within the shell and including a spring-biased stem projecting beyond the slotted end of the shell and adapted for electrical engagement with said circuit element, an electrical terminal element for said conductor anchored to the end portion of said shell remote from its slotted end portion, and said spring contact probe including a sleeve body substantially filling the hollow shell and resisting collapse of said jaws while the spring contact probe is within the shell, the shell having an external shoulder near its end away from said camming enlargements adapted to abut one entrance of the aperture while the camming enlargements are abutting the other entrance with both oppositely tapering faces then disposed outside of the aperture to lock the shell within the aperture.

2. An electrical connector as defined in claim 1, wherein said aperture and shell are cylindrically formed and the shell has a cylindrical bore, and said sleeve of the spring contact probe being cylindrical and engaging snugly within the bore of the shell, and said enlargements on said jaws being oppositely tapered conical enlargements disposed somewhat inwardly from the tips of said jaws.

3. An electrical connector as defined in claim 1, and a serrated head on said spring-biased stem adapted for electrical engagement with a conducting component of said circuit element.

4. An electrical connector for making a connection through an apertured support panel having a metallic layer on one side thereof, said connector comprising a tubular electrical insulating holding shell of a size to fit through an aperture of said panel and layer and to project beyond opposite faces of the panel and layer, one end portion of the tubular shell being cross slotted to form two resilient jaws on the shell, said jaws each having an oppositely tapering enlargement thereon adapted to fit through an aperture of the panel and layer when said jaws are collapsed by camming action of said enlargements with one entrance of said aperture, a metallic pin-like spring contact probe including an outer sleeve and a spring-urged contact stem disposed in the tubular shell snugly with the contact stem projecting beyond the slotted end of the shell, the sleeve of the spring contact probe resisting collapse of said jaws and thereby locking the shell in assembled relationship with said panel and metallic layer releasably, said shell having an external enlarged shoulder thereon near the end of the shell away from said jaws, said enlarged shoulder being incapable of passing through said aperture and positioning the enlargements of said jaws in their shell locking positions immediately beyond one end of the aperture, and a metallic terminal element secured to the end portion of the shell away from said jaws.

* * * * *